US009944491B2

(12) United States Patent
Guiffault

(10) Patent No.: US 9,944,491 B2
(45) Date of Patent: Apr. 17, 2018

(54) FIBER OPTIC/ELECTRICAL CABLE CARTRIDGE SYSTEM

(71) Applicant: Optical Cable Corporation, Roanoke, VA (US)

(72) Inventor: Nicolas Guiffault, Allen, TX (US)

(73) Assignee: Optical Cable Corporation, Roanoke, VA (US)

( * ) Notice: Subject to any disclaimer, the term of this patent is extended or adjusted under 35 U.S.C. 154(b) by 749 days.

(21) Appl. No.: 14/390,136

(22) PCT Filed: Mar. 14, 2013

(86) PCT No.: PCT/US2013/031169
§ 371 (c)(1),
(2) Date: Oct. 2, 2014

(87) PCT Pub. No.: WO2013/187964
PCT Pub. Date: Dec. 19, 2013

(65) Prior Publication Data

US 2015/0108267 A1 Apr. 23, 2015

Related U.S. Application Data

(60) Provisional application No. 61/621,343, filed on Apr. 6, 2012.

(51) Int. Cl.
*B65H 75/44* (2006.01)
*B65H 49/24* (2006.01)
(Continued)

(52) U.S. Cl.
CPC ..... *B65H 75/4471* (2013.01); *B65H 49/24* (2013.01); *B65H 49/322* (2013.01);
(Continued)

(58) Field of Classification Search
CPC .. B65H 49/24; B65H 75/4471; B65H 75/141; B65H 75/403; B65H 49/328;
(Continued)

(56) References Cited

U.S. PATENT DOCUMENTS 5,794,649 A * 8/1998 Spear ..... B65H 75/403 137/355.27
6,050,291 A 4/2000 Whitehead et al.
(Continued)

FOREIGN PATENT DOCUMENTS

CA 1 260 445 9/1989
JP 2006248720 9/2006
(Continued)

OTHER PUBLICATIONS

PCT Patent Application No. PCT/US2013/031169; International Preliminary Report on Patentability; dated Oct. 7, 2014; dated Oct. 16, 2014.
PCT International Search Report; PCT/US2013/031169.

*Primary Examiner* — William E Dondero
*Assistant Examiner* — Nathaniel L Adams
(74) *Attorney, Agent, or Firm* — The Van Winkle Law Firm; William G. Heedy; David M. Carter

(57) ABSTRACT

A cartridge system for a cable reel. The cartridge system includes a case configured to hold the cable reel and a pair of reel roller elements inside the case. Each of the reel roller elements has ends that are connected to opposite sides of the case. Each of reel roller elements has a roller rotatable within the case. The roller is configured to receive a flange of the cable reel such that the cable reel is rotatable within the case.

3 Claims, 13 Drawing Sheets

(51) Int. Cl.
*B65H 49/32* (2006.01)
*B65H 75/40* (2006.01)

(52) U.S. Cl.
CPC ..... *B65H 49/328* (2013.01); *B65H 75/403* (2013.01); *B65H 2402/412* (2013.01); *B65H 2701/32* (2013.01); *B65H 2701/34* (2013.01); *B65H 2701/533* (2013.01); *B65H 2701/534* (2013.01)

(58) Field of Classification Search
CPC ..... B65H 49/322; B65H 2701/32; B65H 2701/533; B65H 2701/34; B65H 2402/412; B65H 2405/115; B65H 2407/32; B65H 54/72; Y10T 16/61
See application file for complete search history.

(56) References Cited

U.S. PATENT DOCUMENTS

| | | | | |
|---|---|---|---|---|
| 6,176,559 | B1 | 1/2001 | Tiramani et al. | |
| 6,523,777 | B2 * | 2/2003 | Gaudio | B65H 49/24 242/594.1 |
| 7,261,328 | B2 * | 8/2007 | Minix | E05B 13/10 292/28 |
| 2008/0191436 | A1 | 8/2008 | Galgano et al. | |
| 2009/0211860 | A1 | 8/2009 | Glenn | |

FOREIGN PATENT DOCUMENTS

| | | |
|---|---|---|
| WO | 98/04489 | 2/1998 |
| WO | 2010/111185 A2 | 9/2010 |

* cited by examiner

FIBER OPTIC/ELECTRICAL CABLE CARTRIDGE SYSTEM

CROSS REFERENCE TO RELATED APPLICATIONS AND CLAIM OF PRIORITY

The present application is related to U.S. Provisional Patent Application No. 61/621,343 filed Apr. 6, 2012 entitled "FIBER OPTIC/ELECTRICAL CABLE REEL CARTRIDGE SYSTEM." U.S. Provisional Patent Application No. 61/621,343 is hereby incorporated by reference into the present application as if fully set forth herein. The present application hereby claims priority under 35 U.S.C. § 119(e) to U.S. Provisional Patent Application No. 61/621,343.

FIELD OF THE INVENTION

The disclosure relates generally to fiber optic and electrical cables, and more particularly to a cartridge system for use in storing, deploying, retrieving and transporting such cables.

BACKGROUND

Communication cables, such as electrical and fiber optic cables, provide fast and reliable media for communications. These cables are used in deployable communication environments, such as broadcasting or military applications, and are often placed on reels for ease of deployment, retrieval and maintenance of the cable. During storage and transportation, cable reels may be placed in shipping containers to protect the cable.

However, different accessories may be used in performing common uses of cables, such as storing, deploying, retrieving and transporting of the cables. This requires that operators purchase, switch out and maintain different cable accessories to use the cable.

Accordingly, there is a need for a cartridge system for use in storing, deploying, retrieving and transporting cables.

SUMMARY OF THE INVENTION

Various embodiments of the present disclosure provide a cartridge system for a cable reel. These embodiments disclose solutions to the problem of efficiently holding, storing, deploying, retrieving and transporting reels of fiber optic/electrical cables.

According to one embodiment of the present disclosure, the cartridge system includes a case configured to hold the cable reel and a pair of reel roller elements inside the case. Each of the reel roller elements has ends that are connected to opposite sides of the case. Each of reel roller elements has a roller rotatable within the case. The roller configured to receive a flange of the cable reel such that the cable reel is rotatable within the case.

According to another embodiment of the present disclosure, the cartridge system includes a first case configured to hold a first cable reel. The first case includes a lid. The cartridge system includes a second case configured to hold a second cable reel. The second case is stackable onto the lid of the first case. The cartridge system also includes a connector configured to connect the second case to the lid of the first case.

According to yet another embodiment of the present disclosure, the cartridge system includes a case configured to hold the cable reel, a pair of wheels attached to the case, and a lid rotatably connected to the case via a hinge. The lid configured to cover an opening of the case in an opened position and to allow, in an opened position, an operator to tilt and roll the case on the wheels.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DESCRIPTION OF THE PREFERRED EMBODIMENTS

Figure 9:
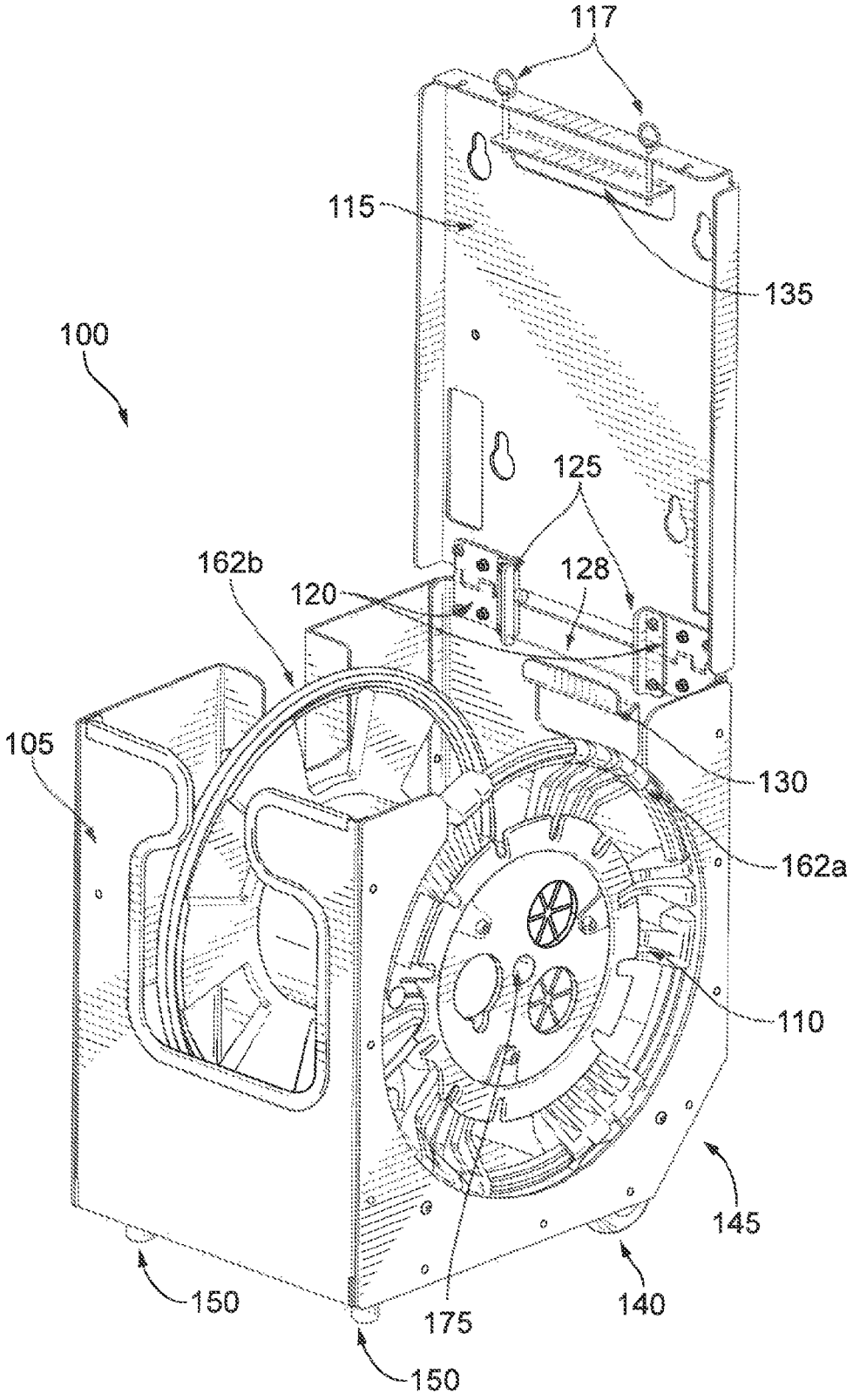
FIG. 9 illustrates the cartridge system of FIG. 8 holding a cable reel in accordance with various embodiments of the present disclosure.

The cartridge system 100 functions as a self-contained fiber optic/electrical cable reeling system for broadcast, military or deployable communication environments, and provides an enclosure for holding, storing, deploying, retrieving and transporting reels of fiber optic/electrical cables. For example, the system 100 includes a case or housing 105 forming the exterior which may be constructed of metal, plastic, composite materials and/or any other suitable materials or combinations thereof. The cartridge system 100 provides a rigid and protective container for a cable reel 110 (as illustrated in FIG. 9) and can be used to hold, store, protect, deploy, retrieve and/or transport the cable reel 110. This may eliminate the need for a separate shipping or transportation container.

Figure 10A:
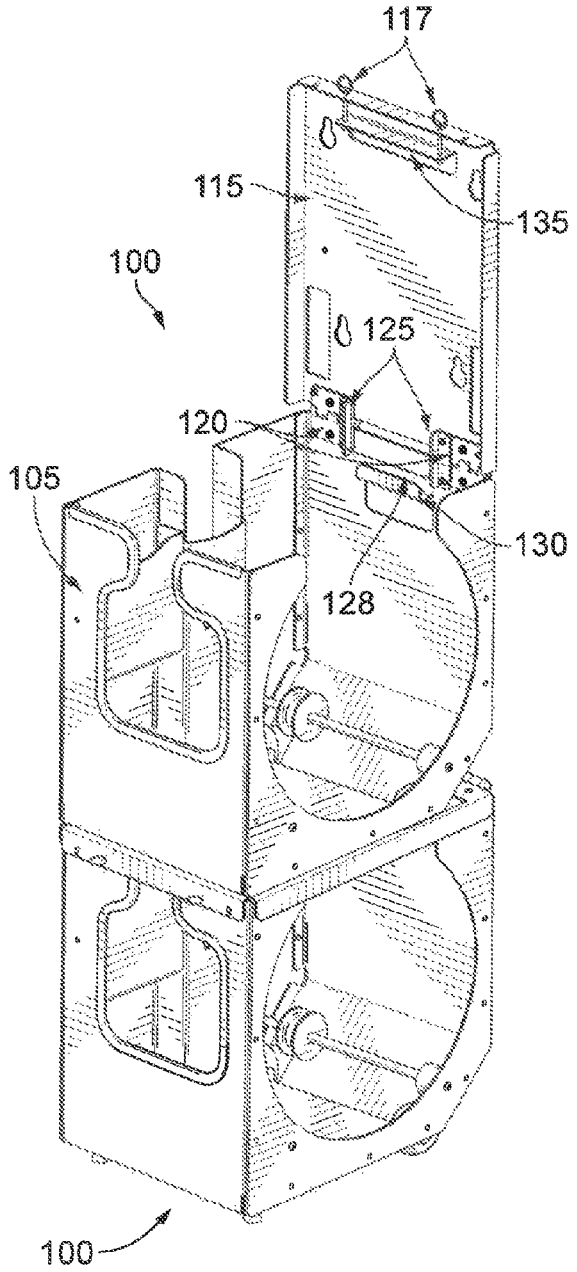
FIGS. 10A and 10B illustrate perspective views of a cartridge system including two cases stacked one on the other in accordance with various embodiments of the present disclosure.
Figure 10B:
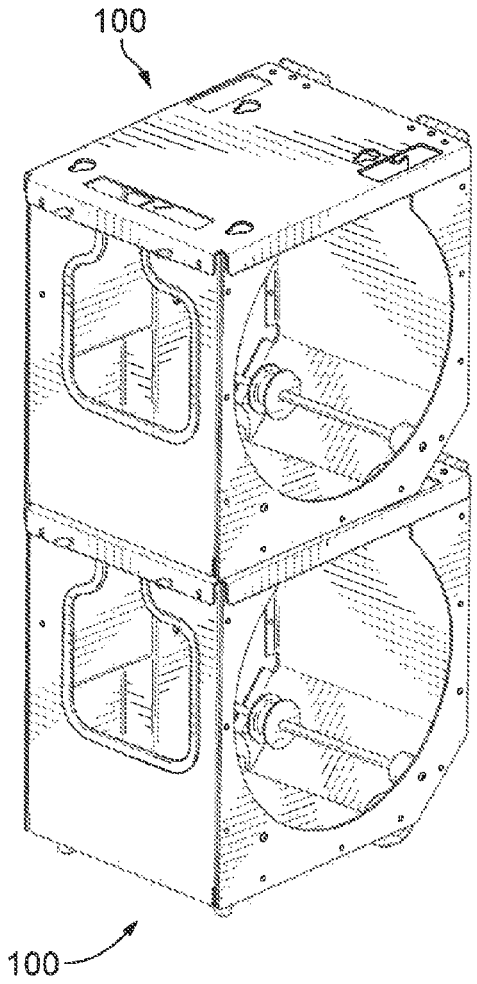

As illustrated in FIGS. 10A and 10B, multiple cartridge systems 100 can be stacked on one another. As illustrated also in FIGS. 1 and 2 the lid 115 includes openings or slots 180 and 185 that are positioned to match and mate with the wheels 140 and the mounts 150 on the bottom side of another cartridge system 100. When placed on top, the wheels 140 and the mounts 150 (at least portions thereof) of one cartridge system 100 will protrude or nest into the slots 180, 185 within the lid 115 of another cartridge system 100.

It may be advantageous to set forth definitions of certain words and phrases used throughout this patent document the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, and those of ordinary skill in the art should understand that in many, if not most instances, such definitions apply to prior, as well as future uses of such defined words and phrases.

FIGS. 1 through 12B, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Referring in general to FIGS. 1-10B there are shown various views of one or more cartridge systems 100 in accordance with various embodiments of the present disclosure. The cartridge system 100 functions as a self-contained fiber optic/electrical cable reeling system for broadcast, military or deployable communication environments, and provides an enclosure for holding, storing, deploying, retrieving and transporting reels of fiber optic/electrical cables. For example, the system 100 includes a case or housing 105 forming the exterior which may be constructed of metal, plastic, composite materials and/or any other suitable materials or combinations thereof. The cartridge system 100 provides a rigid and protective container for a cable reel 110 (as illustrated in FIG. 9) and can be used to hold, store, protect, deploy, retrieve and/or transport the cable reel 110. This may eliminate the need for a separate shipping or transportation container.

Now turning to FIG. 9, there is illustrated one example of a cable reel 110 that may be disposed within the cartridge system 100. Additional examples of cable reels that may be held, stored, protected, deployed, retrieved and/or transported using the cartridge system 100 are described in U.S. Pat. No. 6,074,916 and U.S. Provisional Patent Application No. 61/513,346, which are incorporated by reference herein.

Figure 1:
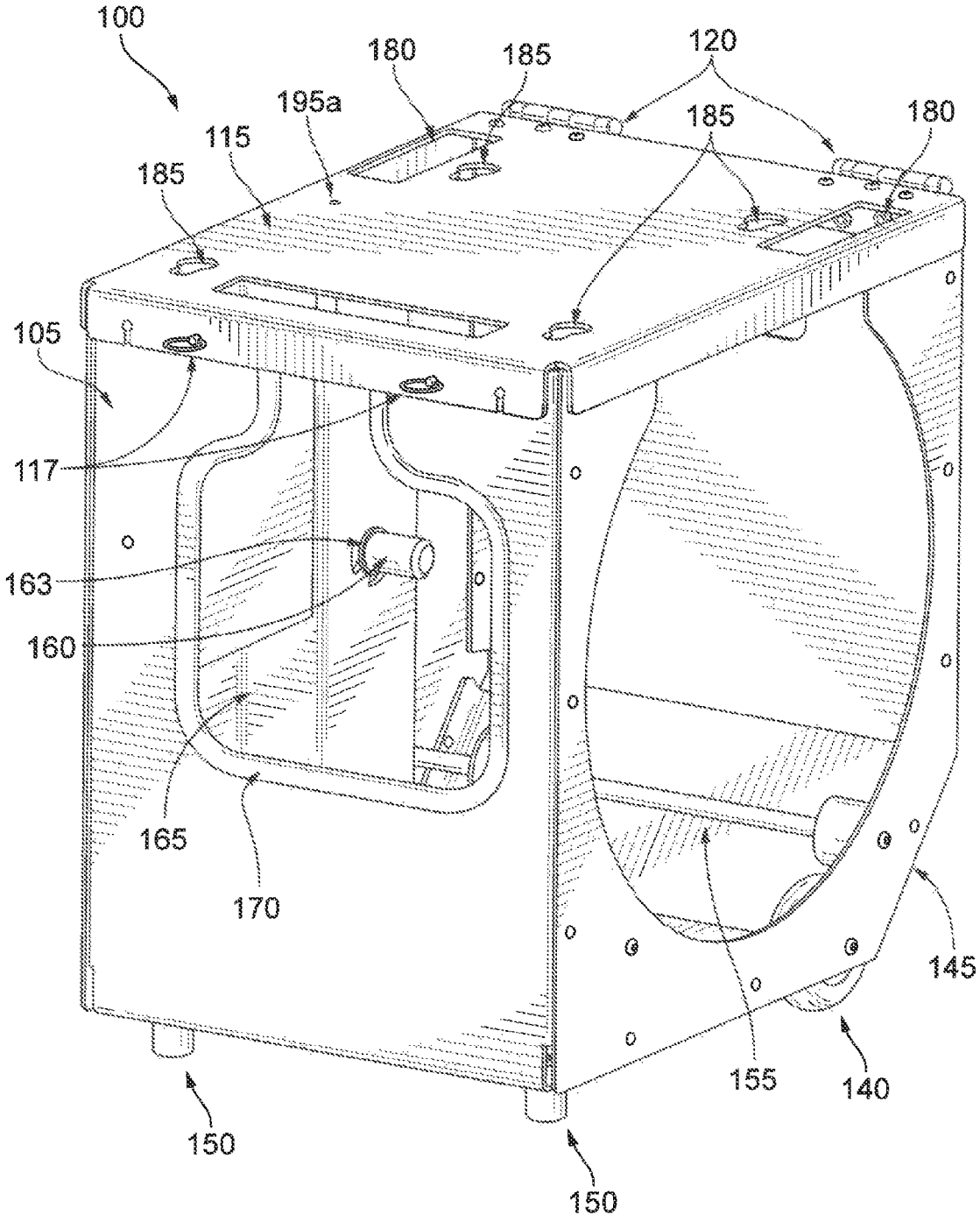
FIGS. 1-3 illustrate perspective views of a cartridge system for a cable reel in accordance with 10 various embodiments of the present disclosure.
Figure 2:
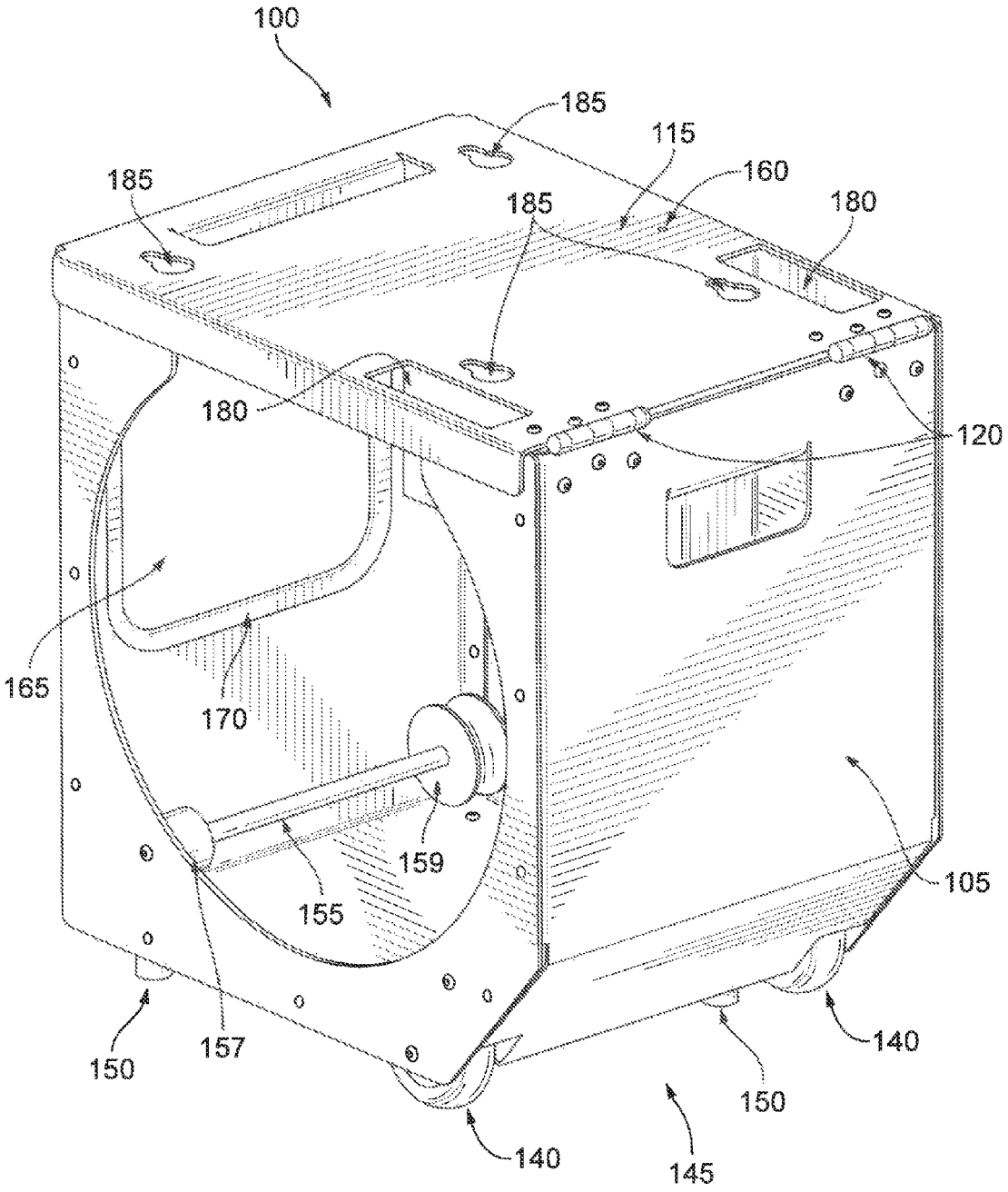

The cartridge system 100 includes a lid 115 for opening and closing using hinges 120 as illustrated, for example, in FIGS. 1 and 9. While two hinges 120 are depicted in this illustrative example, any number of hinges may be used in accordance with the embodiments of the present disclosure. When the lid 115 is closed, pins 117 may be inserted into holes 119 (illustrated for example, in FIGS. 7B and 8) in the case 105 to lock or otherwise secure the lid 115 in a closed position. While hinges 120 and pins 119 are described, other components r structures may be used to provide a hinging function and secure the lid 115.

The cartridge system 100 also includes one or more latches 125. The latches 125 are configured to hold the lid 115 open in an upright position, as illustrated in FIGS. 7A, 7B, 8, 9 and 10A. A first end of the latches 125 is rotatably attached to the lid 115 of the case 105. For example, a pin may connect the latches 125 to the lid 115 such that the latches 125 can rotate axially in a plane that is substantially parallel to the surface of the lid 115. In one embodiment, the latches 125 may be directly connected to the lid 115, while in other embodiments, they may be connected to the lid 115 through the hinges 120. For example, the latches 125 may be connected to an upper hinge member of the hinges 120 that is connected to the lid 115.

A second end of the latches 125 includes a slot for mating with, or latching to, a protrusion member disposed on the inside of the case 105, such as a nut or pin on the inside of the case 105, or on the lower hinge member of the hinges 120. Once latched, the latches 125 rigidly secure the lid 115 in the opened position (as shown, for example, in FIGS. 6A-9).

The orientation and configuration of the latches 125 to the lid 115 permits, for example, the latches 125 to fall or drop onto the protrusion member on the inside of the case 105 when an operator of the cartridge system 100 lifts or opens the lid 115. In this manner, upon opening the lid 115, the force of gravity causes the latches 125 to fall (move) and become latched in place thus securing or holding the lid 115 of the case 105 in an open position.

In various embodiments, the cartridge system 100 includes a cord 128 (illustrated, for example, in FIGS. 7B, 8, 9, 10A, 13A and 13B) to ease in unlatching the latches 125 from the case 105 to close the lid 115. In these illustrative embodiments, opposite ends of the cord 128 are attached to the second end of the latches 125. By pulling on the cord 128, the slots of the latches 125 move away from the protrusion members (on the case 105 or the lower hinge member) thereby unlatching both of the latches 125 with a single pull. This configuration of the cord 128 may simplify unlocking or unlatching the lid 115 from a latched open position.

The cartridge system 100 includes a pair of opposing handles 130, 135 (formed as part of the list 115 and within an outer wall of the case 105, respectively) and a plurality of wheels 140. The handles 130 and 135 and the wheels 140 enable more easy transportation of the cartridge system 100 through areas where deployment, retrieval and transportation of cable reels 105 is desired, such as airports, stages and other venues. In this manner, the lid 115 may function to enclose a cable reel 110 within the case 105 and for pushing or pulling the cartridge system 100 on the wheels 140.

As shown in the FIGURES the case or housing 105 is constructed with an angled portion 145 near the lower rear end of the case 105 which allows an operator to tilt the cartridge system 100 to lift the front portion of the case 105 (e.g., having mounts 150) into the air for balancing the case on the wheels 140 for ease in transportation. The angled portion provides sufficient clearance between the case 105 and the ground/floor when the case 105 is tilted onto the wheels 140 for rolling along the ground/floor.

Either or both of the handles 130, 135 may be used to carry or move the cartridge system 100. For example, either of the handles 130, 135 may be used depending on one or more of the height of the operator, the number of cartridge systems 100 used, the position of the lid 115, and the preferred angle for pulling or pushing the one or more cartridge systems 100. In one example, with the lid 115 in an open position, for maneuvering a single cartridge system 100, an operator may use the handle 135 located on or formed within the lid 115. In another example, when maneuvering two or more two cartridge systems 100 (such as having one on top of another as illustrated in FIGS. 10A and 10B), an operator may use the handle 130 located on or formed within a sidewall or housing of the case 105.

The cartridge system 100 has disposed within the interior of the a 105 two reel roller elements 55 and a spindle member 160 having an externally protruding portion with a knob 162 attached thereto. The reel roller elements 155 support the cable reel 110 when it is disposed within the case 105, while the spindle member 160 (in its extended position) holds or maintains the cable reel 110 within the case 105. The reel roller elements 155 receive and rotatably match with elements of the cable reel 110. In these illustrative examples, the case 105 has two reel roller elements 155, one near the front and one near the back of the case 105, which function to support the cable reel 110 and enable rotation while in a stationary position within the case 105. The reel roller elements 155 have opposite ends that are connected to opposite sides of the case 105.

These reel roller elements 155 function in cooperation with the spindle member 160 secure or hold the cable reel 110 disposed inside the case 105 in a manner such that the cable reel 110 can be rotated within the case 105. This enables deployment and retrieval of the cable from the cable reel 110 while the cable reel 110 is set within the case 105. For example, each of the reel roller elements 155 may include a roller 157 and a roller 159 disposed about an axle 156 (illustrated, for example, in FIGS. 2, 8 and 11A-12B). This allows the cable reel 110 to spin/rotate while in a stationary position within the case 105 of the cartridge system 100. As will be appreciated, in other embodiments, the spindle member 160 may be optional.

In various embodiments, the rollers 157, 159 may be configured or shaped with a flat outer surface (e.g., rollers 157) or a curved (concave) outer surface (e.g., rollers 159). In the embodiment shown, the rollers 157 have a flat outer surface while the rollers 159 include a concave shaped outer surface. Any suitable configuration or shape for the roller elements 157, 159 may be utilized, but it will be appreciated that the particular configuration or shape will generally correspond to the configuration/shape of the cable reel 110 disposed in the case 105. It will be understood that the rollers 157, 159 may both have a flat surface, a curved surface, or one may have a curved surface and one may have a flat surface, and in one embodiment, one roller has a flat surface while the other roller has a curved surface.

For example, a flange 162*a* of the cable reel 110 (e.g., one of the outer rims of the of the cable reel 110) may be supported by (and in contact with) the flat outer surface of the rollers 157, while a flange 162*b* of the cable reel 110 (e.g., one of the other outer rims of the cable reel 110) may be supported by (and in contact with) the curved outer surface of the rollers 159. The curved outer surface of the rollers 159 may have a radius of curvature substantially similar or matched to the radius of curvature of the flange 162*b*.

The reel roller elements 155 enable the cable reel 110 to be rotated in allow for the deployment/retrieval of a cable while the cable reel 110 is disposed within the case 105. For example, the cable may be deployed and retrieved through an opening 165. The rollers 157, 159 may be rigidly fixed to the axle 156 (so that the axle and rollers may rotate as one unit) or may rotate about the axle 156 (with the axle 156 rigidly fixed) with or without bearings (not shown). Though the illustrative embodiment describes the reel roller elements 155 in a configuration including an axle and rollers, other mechanical structures and/or components may be utilized, as desired, so that a cable reel 110 can rotate relatively freely (with low friction) while disposed within the case 105 to deploy/retrieve a cable from the cable reel 110.

In one embodiment, the edges forming the opening 165 may include a covering material 170 to reduce friction or wear on the cable as it is deployed and retrieved. For example, the edges may be covered using a rubber, plastic, or composite material.

In these illustrative embodiments of the present disclosure, the cartridge system 100 (case 105 and cable reel 110) provides an efficient means for holding, storing, protecting, deploying, retrieving and transporting optical fiber/electrical cables. For example, an operator may deploy an optical fiber/electrical cable (wound about the cable reel 110) by inserting the cable reel 110 into the case 105, pulling one end of the cable through opening 165, attaching that end to a fixed point, and moving the cartridge system 100 away from the fixed point (or fixing the position of the cartridge system 100 and pulling the cable outward). For example, the operator may roll the cartridge system 100, and, as the operator moves the cartridge system 100, the cable is deployed as the cable reel 110 rotates inside the case 105 on the reel roller elements 155. In another embodiment, an operator may stack two or more cartridge systems 100 and deploy two or more cables at the same time.

An operator may also retrieve the optical fiber/electrical cable within the cartridge system 100. For example, the operator may rotate the cable reel 110 inside the case 105 to retrieve the cable and wind it back on the cable reel 105. In some embodiments, the cartridge system 100 or cable reel 110 may include a handle or crank (not illustrated) for rotating the cable reel 110 to retrieve and/or deploy the cable. In one example, the cable reel 110 may include a retractable handle that extends outward and is accessible through the large opening in the side of the case 105.

The spindle member 160 is configured and positioned to mate with an arbor hole 175 (e.g., arbor hole 50 in FIG. 1 of U.S. Pat. No. 8,074,916 within the cable reel 110. In this embodiment, the spindle member 160 is intended not to be weight-carrying, and the rollers 157, 159 carry the weight of the cable reel 110, though in other embodiments, the spindle member 160 may be constructed and configured to provide weight-carrying capabilities. The spindle member 160 includes the knob 162, a pin extension 163 and a spring (not shown). When in the extended position, the pin extension 163 extends into the interior of the case 105 and through the arbor hole 175 of the cable reel 110 therein. When retracted, the pin extension is clear of the arbor hole 175 which allows the cable reel 110 to be inserted or removed from the case 105. Thus, even if the case 105 is turned upside down and the lid 105 is not closed, the spindle member 160 functions to substantially secure the cable reel 110 within the case 105.

Though the embodiment of the spindle member 160 illustrated and described herein is in the form and function of a spring-loaded pin, handle or latch (e.g., spring loaded T-handle, ball knob with spring-loaded pull pin), other embodiments may be utilized as desired (e.g., removable bolt and nut, etc.). To remove the cable reel 110, an operator may pull the knob 162 of the spindle member 160 and lift the cable reel 110 from the case 105. In some embodiments, the cartridge system 100 allows multiple different cable reels to be exchanged within one platform.

As illustrated in FIGS. 10A and 10B, multiple cartridge systems 100 can be stacked on one another. As illustrated also in FIGS. 1 and 2, the lid 115 includes openings or slots 180 and 185 that are positioned to match and mate with the wheels 140 and the mounts 150 on the bottom side of another cartridge system 100. When placed on top, the wheels 140 and the mounts 150 (at least portions thereof) of one cartridge system 100 will protrude or nest into the slots 180, 185 within the lid 115 of another cartridge system 100.

Now turning to FIGS. 4A-4B and 5A-5B, there is shown one embodiment illustrating in more detail the mounts 150 (four shown) and the wheels 140 (two shown) on the bottom side of the case 105. Each of the mounts 150 may include a groove 152 which functions in combination with the shape of the slots 185 to hold two stacked cases 105 together. For example, the mounts 150 may fit within the larger portion of the slots 185 of a second cartridge system 100, the case 105 may be moved laterally and the grooves 152 in the mounts 150 may be slid onto and mechanically engage the smaller tapered portion of the slots 185. The engagement of the grooves 152 onto the tapered portion of the slots 185 provides a vertical connection between the two cartridge systems 100.

In a different embodiment, a removable pin 190 (e.g., a ball lock pin, positive locking pin, quick release pin, etc.) may be included to further couple and secure together two cartridge systems 100 stacked together. In one example, the pin 190 may be designed to sustain at least 600 pounds of force. Once stacked, the pin 190 may be inserted through a hole 195*b* in the bottom portion of an upper stacked case 105 (see FIGS. 3, 5A) which is aligned with a hole 195*a* (see FIGS. 1-3) within the lid 105 of a lower stacked case 105. This assists in preventing the cartridge two stacked systems 100 from decoupling horizontally, thus maintaining the a substantially rigid connection between two stacked cartridge systems 100.

Figure 3:
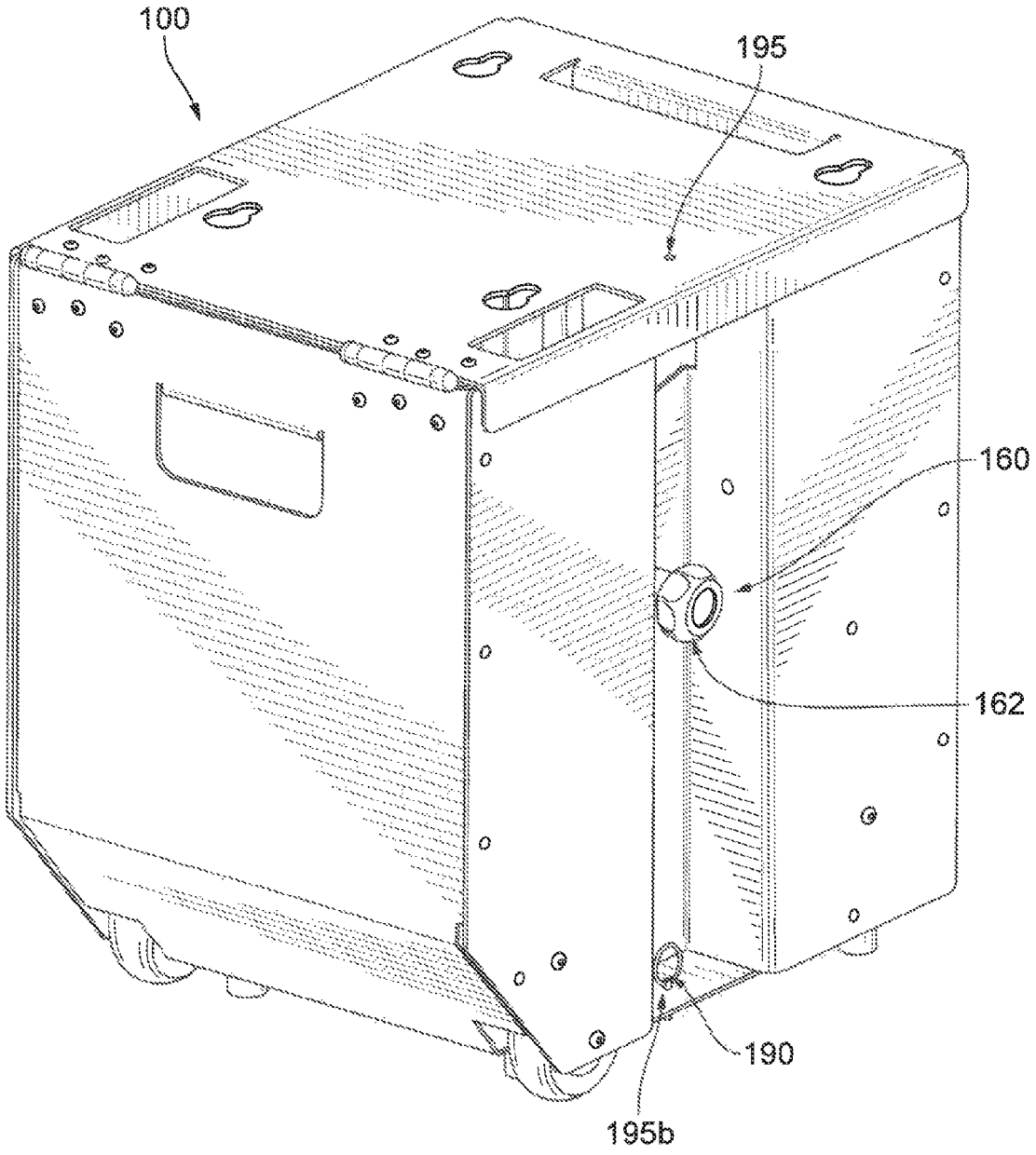
Figure 4B:
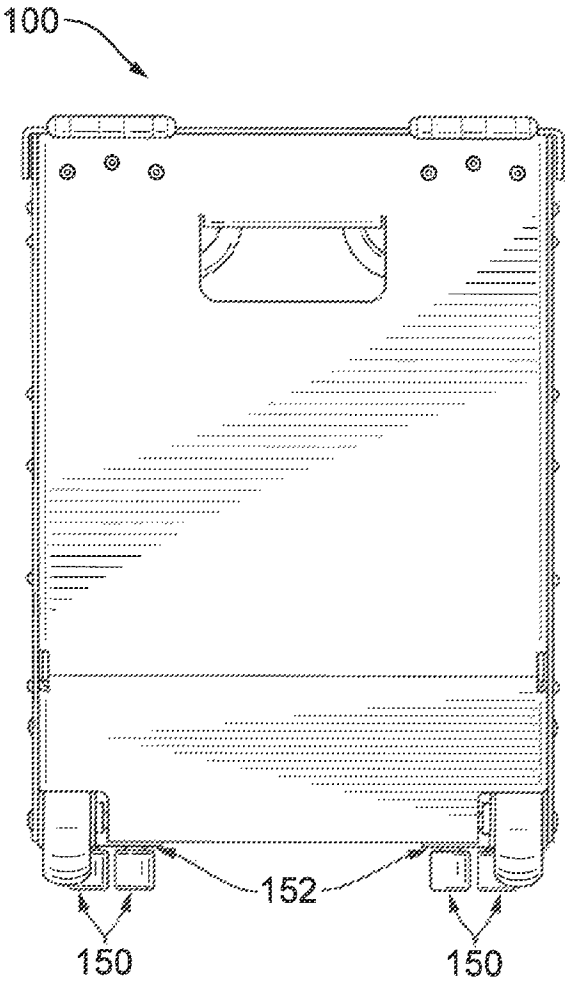
FIGS. 4A and 4B illustrate side and back views, respectively, of the cartridge system illustrated in FIGS. 1-3 with a lid in a closed position in accordance with various embodiments of the present disclosure.
Figure 4A:
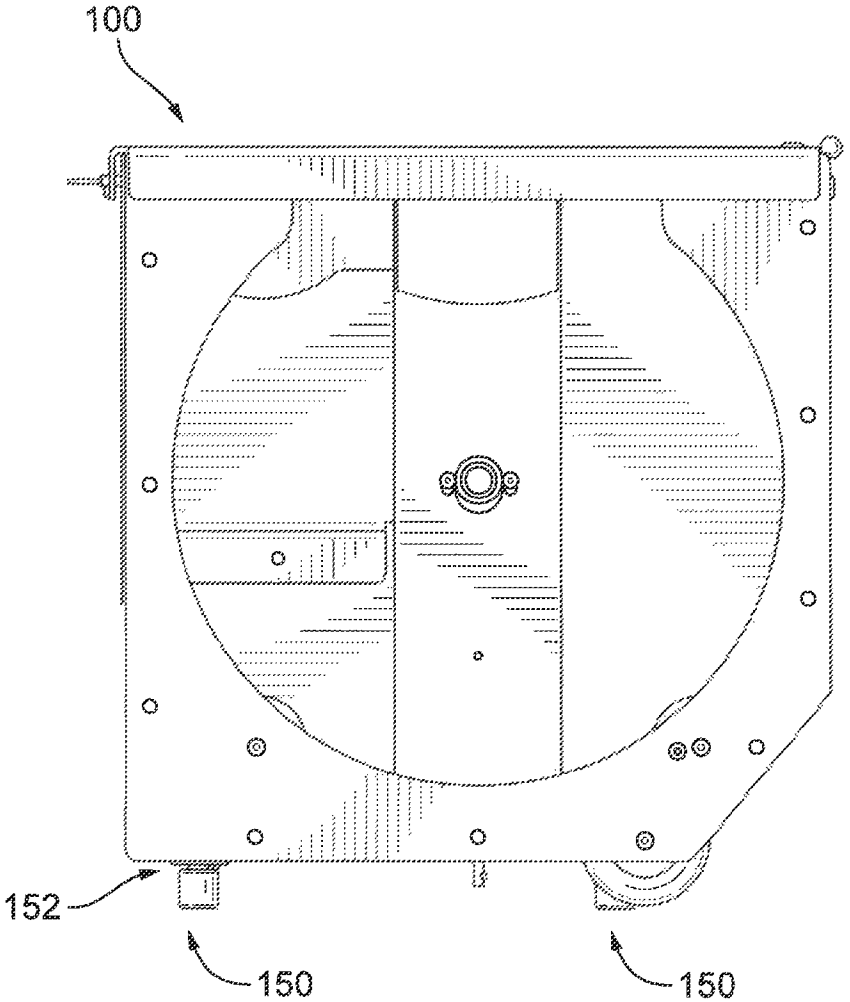
Figure 5B:
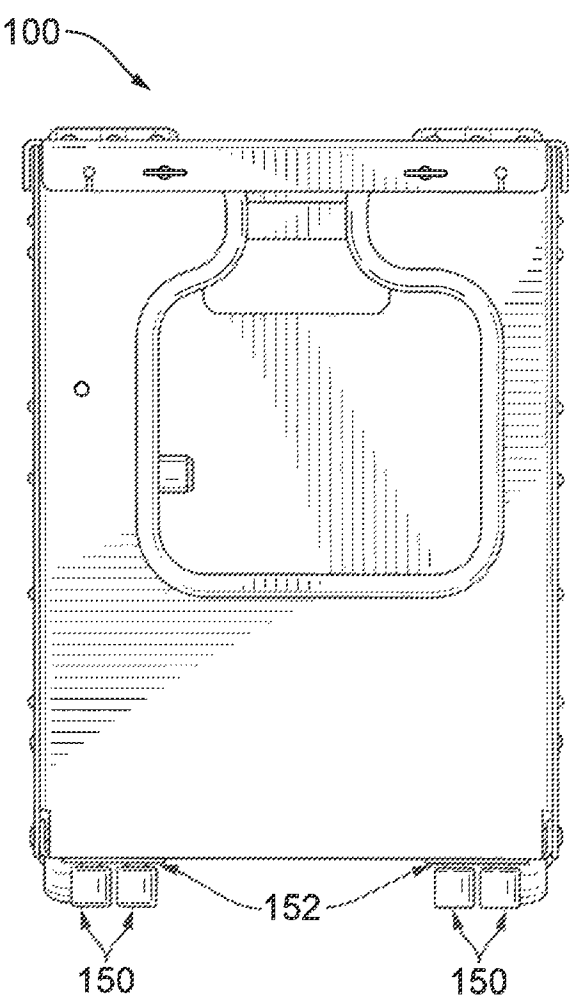
FIGS. 5A and 5B illustrate side and front views, respectively, of the cartridge system illustrated in FIGS. 1-3 with a lid in a closed position in accordance with various embodiments of the present disclosure.
Figure 5A:
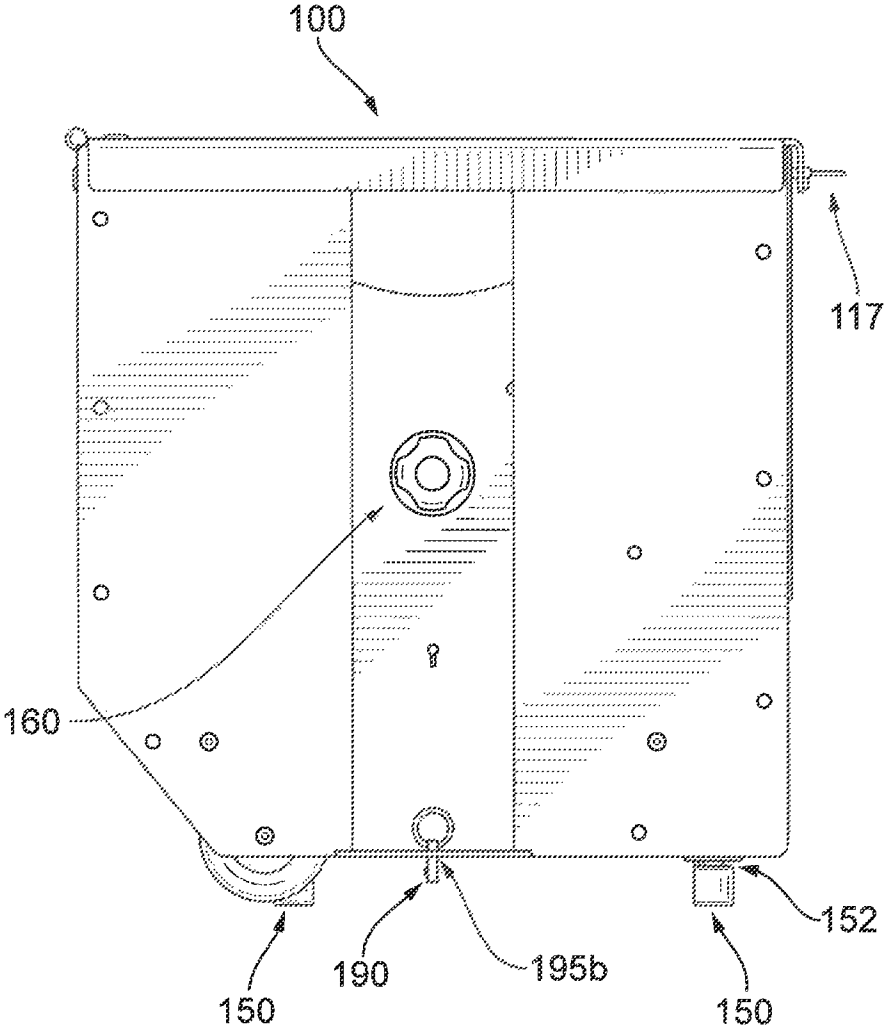
Figure 6A:
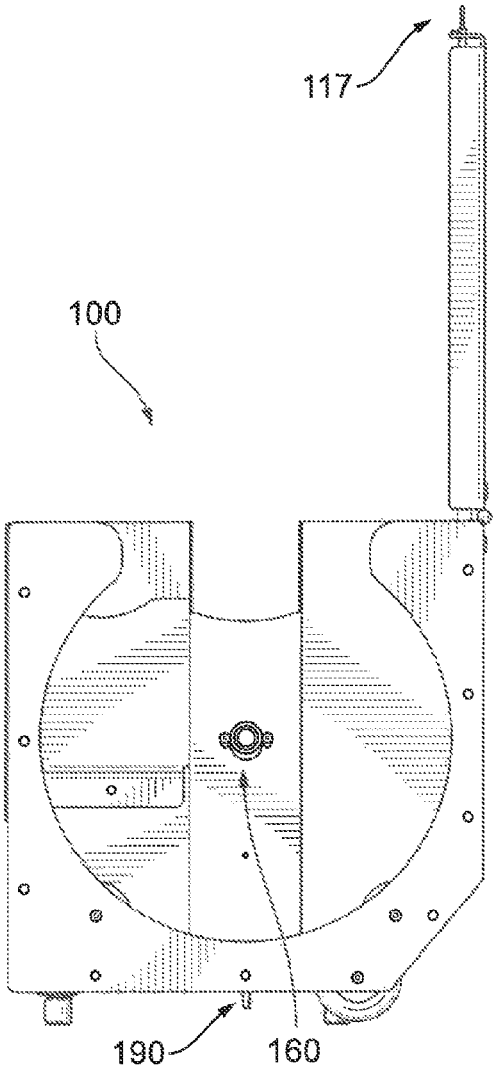
FIGS. 6A and 6B illustrate side and back views, respectively, of the cartridge system illustrated in FIGS. 1-3 with a lid in an opened position in accordance with various embodiments of the present disclosure.
Figure 6B:
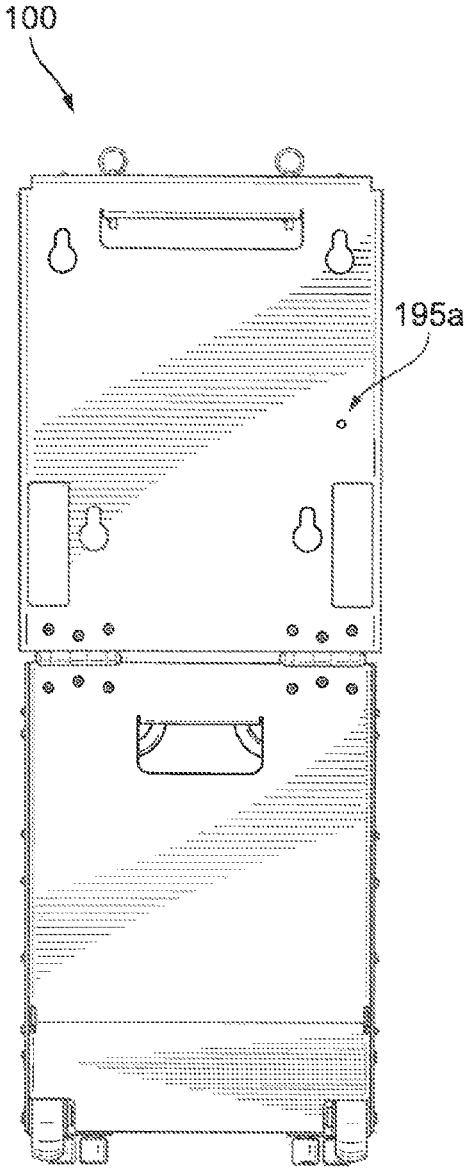
Figure 7A:
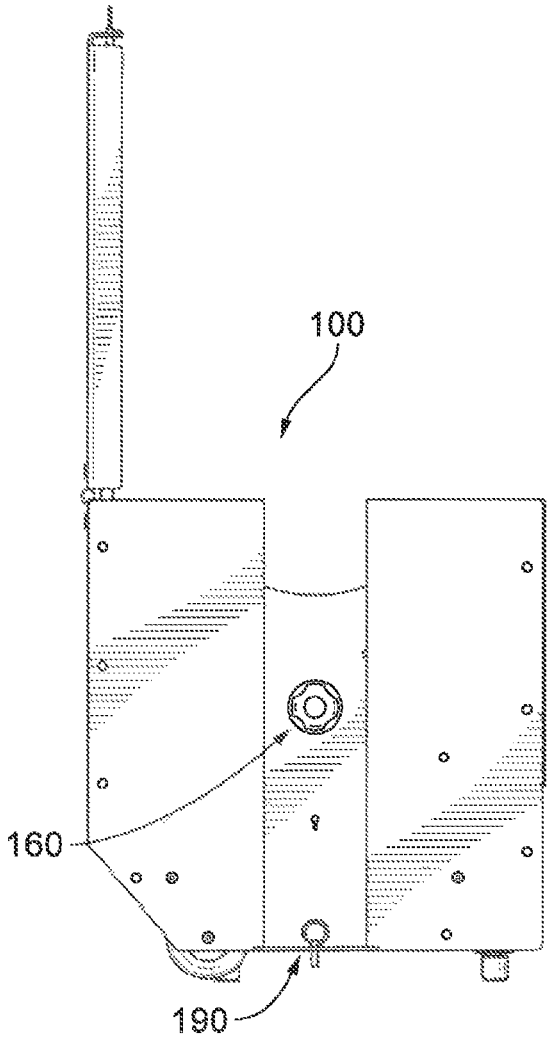
FIGS. 7A and 7B illustrate side and front views, respectively, of the cartridge system illustrated in FIGS. 1-3 with a lid in an opened position in accordance with various embodiments of the present disclosure.
Figure 7B:
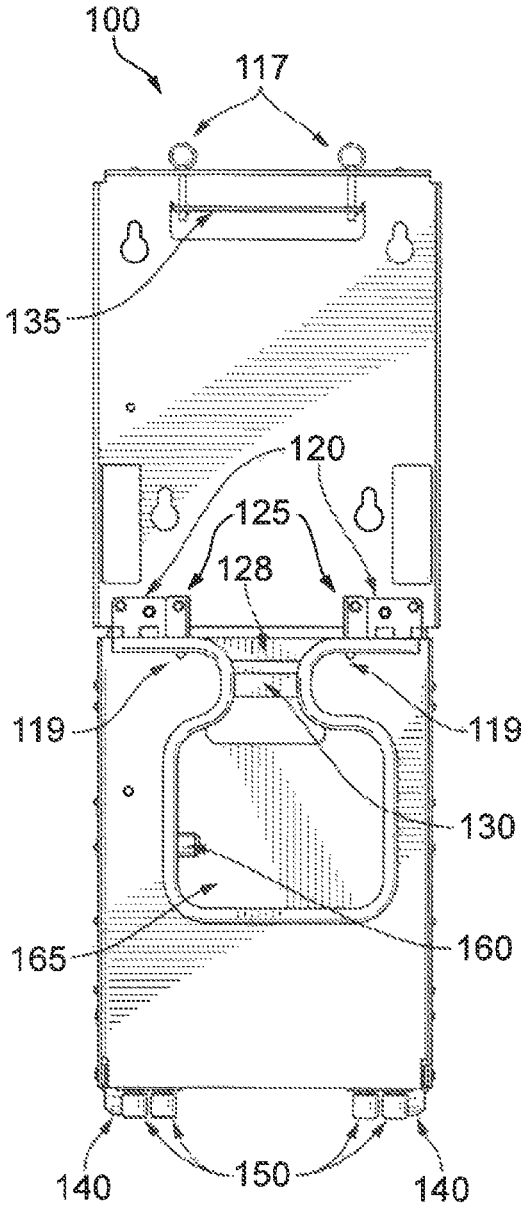
Figure 8:
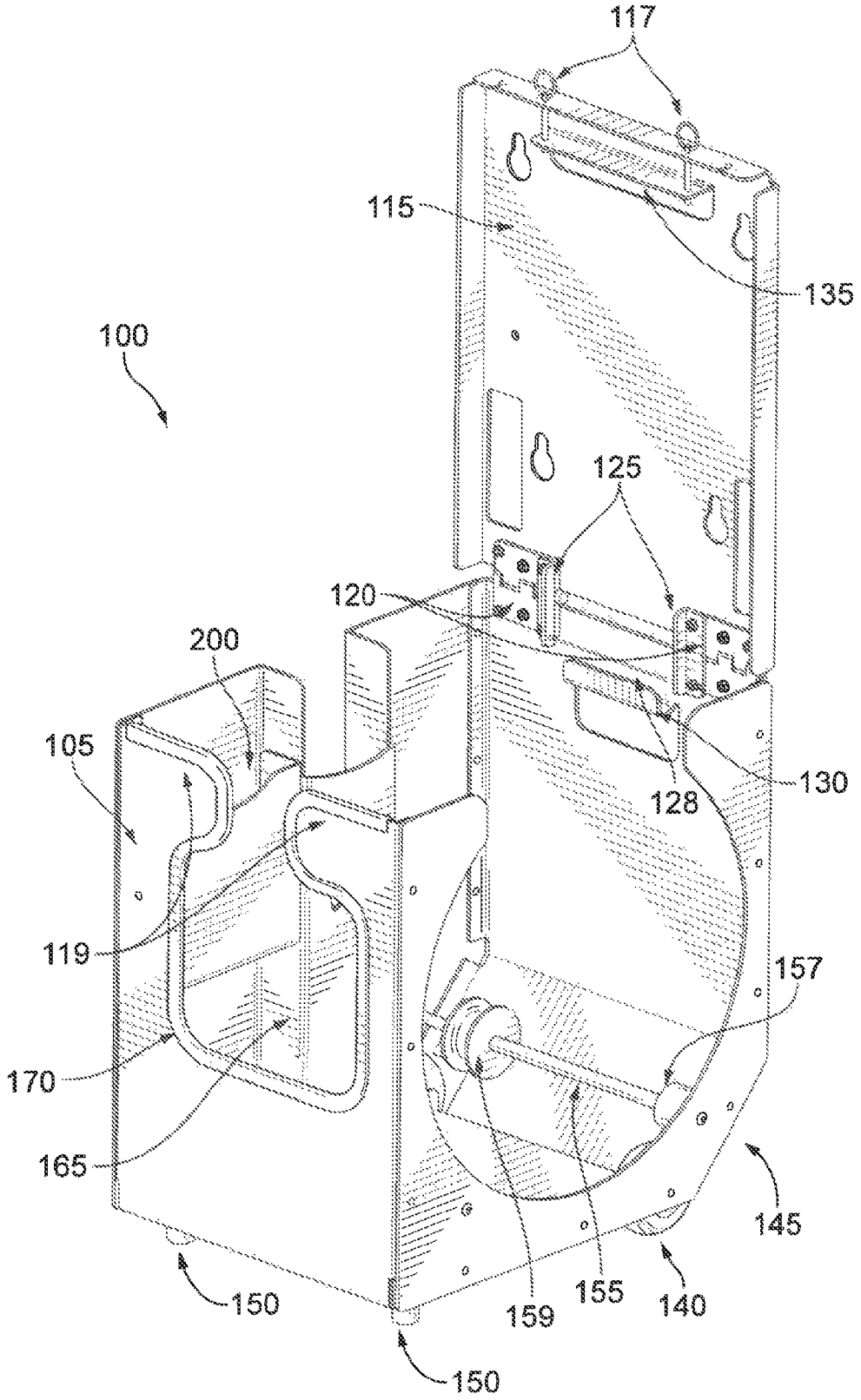
FIG. 8 illustrates a perspective view of the cartridge system illustrated in FIGS. 1-3 with a lid in an opened position in accordance with various embodiments of the present disclosure.

In various embodiments, the pin 190, as illustrated in FIGS. 3, 5A and 7, holds or locks two cartridge systems 100 together during storage, transportation, deployment, and retrieval. In these illustrative embodiments, an operator may stack and move two or more cartridge systems 100 using one or more handles 130, 135 of one or more of the stacked cartridge systems 100.

In some embodiments, the cartridge system 100 includes a storage area 200 inside the case 105 for storing tools and components that may be used during storage, transportation, deployment and retrieval. For example, the storage area 200 may be configured as a built-in tool box that stores the tools and components during transport.

Figure 11A:
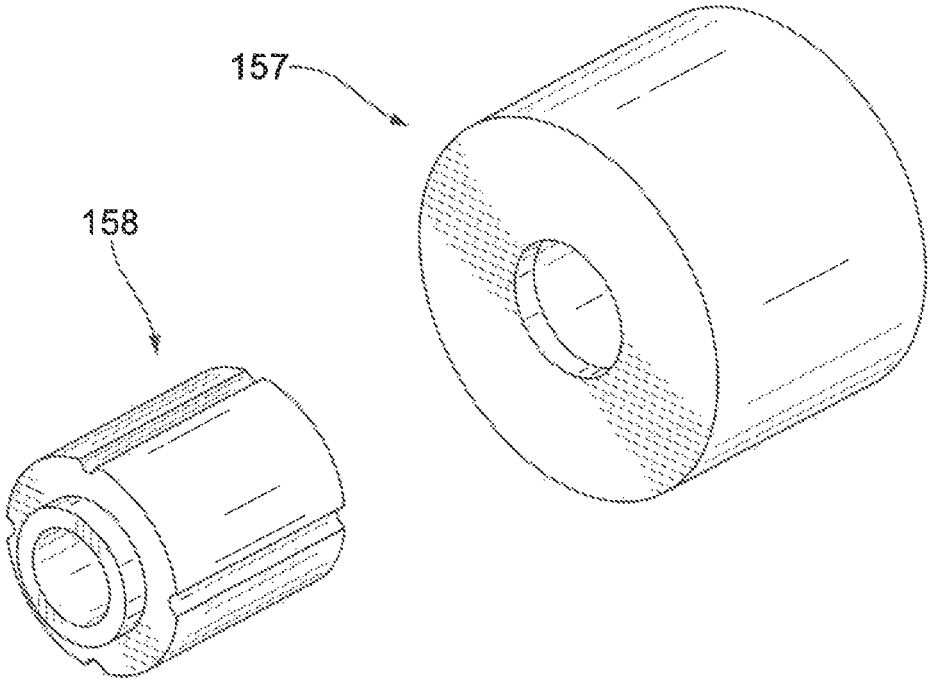
FIGS. 11A and 11B illustrate a flat roller for a reel roller element in a cartridge system in accordance with various embodiments of the present disclosure.
Figure 11B:
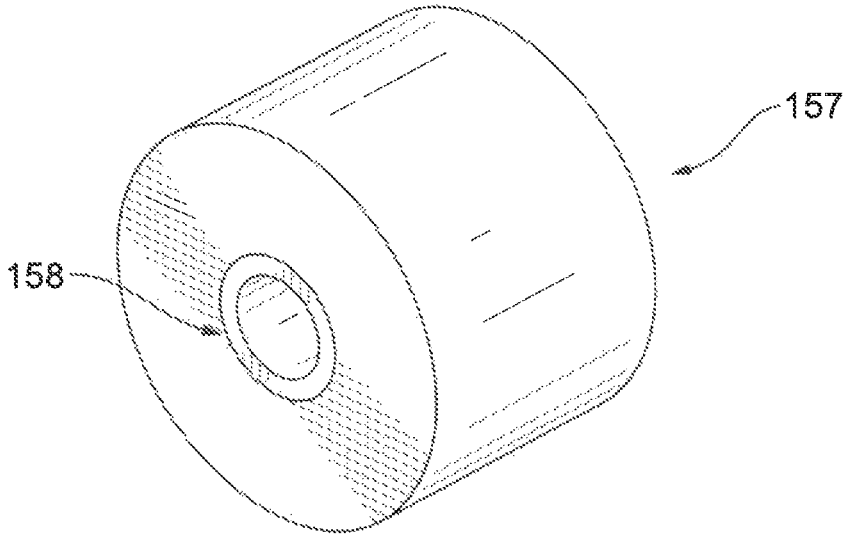

Now turning to FIGS. 11A and 11B, there is illustrated in more detail the flat roller 157 of the reel roller element 155 within the cartridge system 100 in accordance with various embodiments of the present disclosure. In this embodiment, the flat roller 157 includes a bearing 158 which may be made from a hard material, such as metal, plastic or composite material (e.g., a polymer such as acetal) that can rotate on the axle of the reel roller element 155. The roller 157 may be molded over the bearing 158 using a softer material to reduce noise that may be caused by the cable reel 110. For example, the molded portion of the roller 157 may be made from rubber.

Figure 12A:
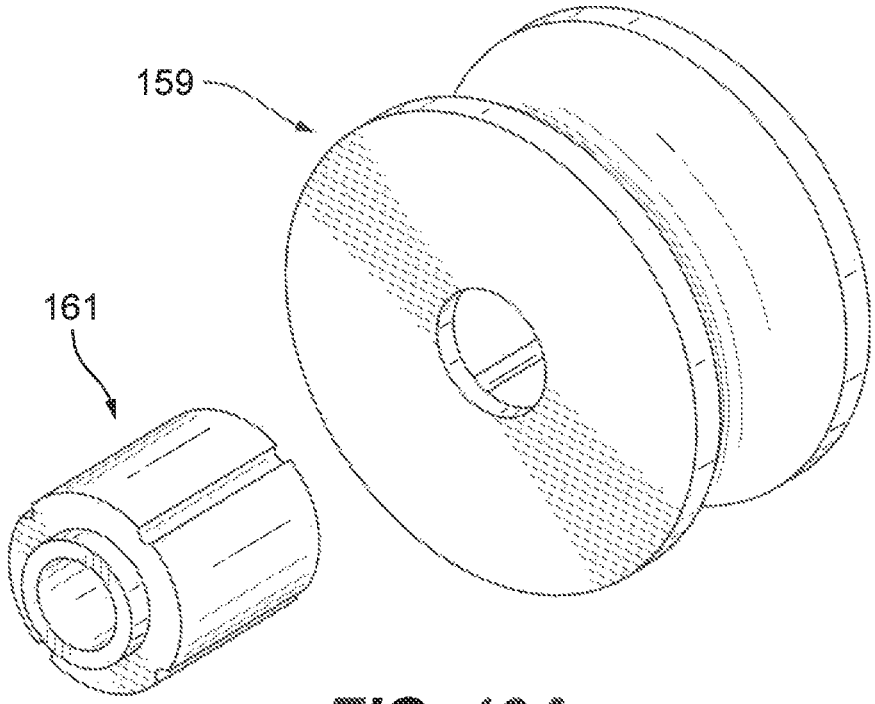
FIGS. 12A and 12B illustrate a curved roller for a reel roller element in a cartridge system in accordance with various embodiments of the present disclosure.
Figure 12B:
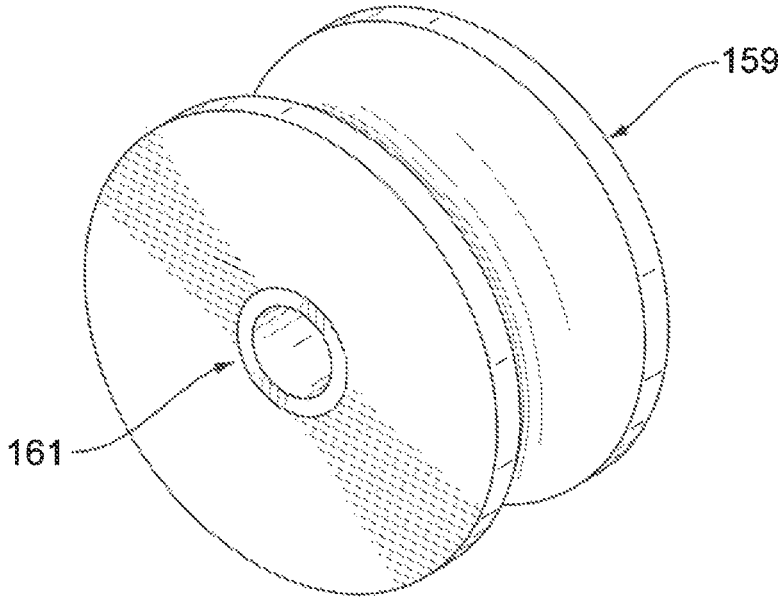
Figure 13A:
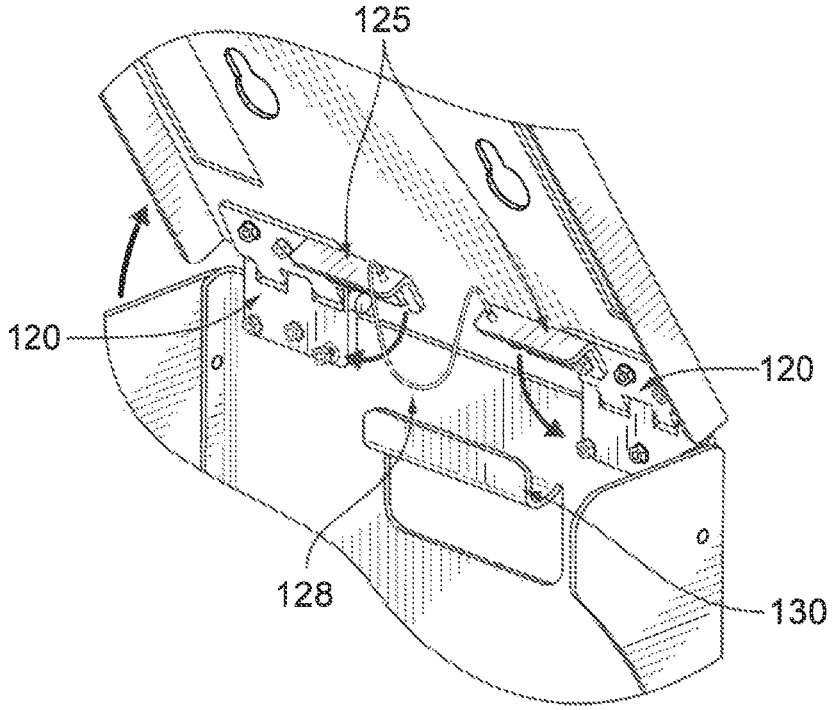
FIGS. 13A and 13B illustrate an isolated view of the operation of the latches.
Figure 13B:
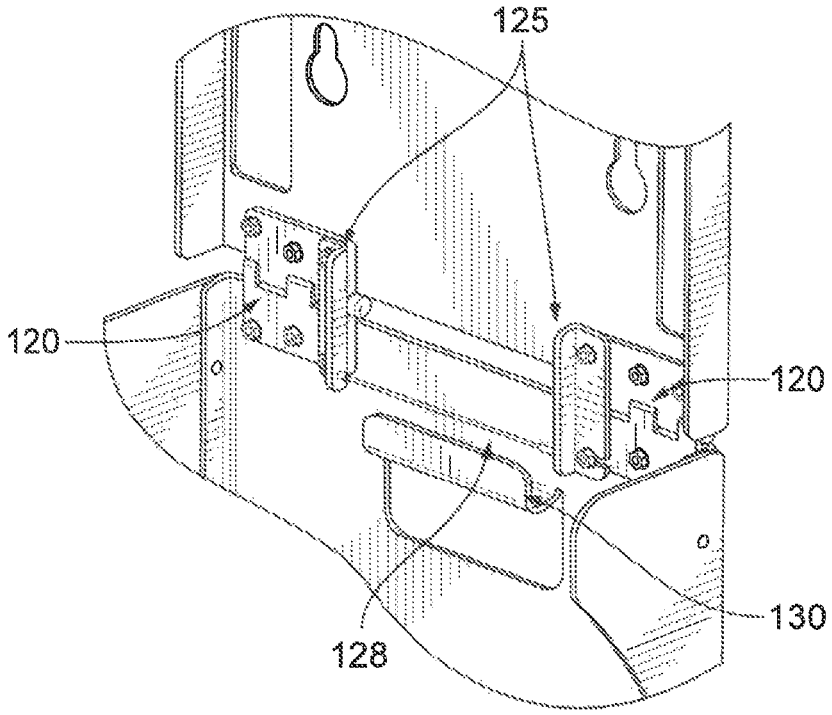

Similarly, FIGS. 12A and 12B illustrate the curved roller 159 of the reel roller element 155 in a cartridge system 100 in accordance with various embodiments of the present disclosure. In this embodiment, the curved roller 159 includes a bearing 161 which may be made from a hard material such as metal, plastic or composite material (e.g., a polymer such as acetal) that can rotate on the axle of the reel roller element 155. The roller 159 may be molded over the bearing 161 using a softer material to reduce noise that may be caused by the cable reel 110. For example, the molded portion of the roller 159 may be made from rubber.

As illustrated, the outer surface of the roller 159 is curved or has a concave or 'u' shape. This shape permits the one of the flanges 162 of the cable reel 110 to sit within the roller 159 and allows the roller 159 to act as a guide for the cable reel 110. For example, the flange 162 positioned within the roller 159 can assist in maintaining horizontal alignment of the cable reel 110 relative to the case 105.

Various embodiments of the present disclosure provide a cartridge system for a cable reel to assist in storing, deploying, retrieving and transporting cables. Various embodiments provide rollers within the case that allow the same case that is used for transportation and storage to be easily used in deploying and retrieving the cable. Various embodiments provide wheels, handles and a lid for the cartridge system that can make cables easy to deploy and transport. Various embodiments also provide stackability of the cartridge system, which may permit a single operator to deploy more than one reeled cable at the same time.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The way in which the invention is capable of being exploited and the way in which it can be made and used will be apparent from the foregoing, particularly in regard to storing, moving, and transporting reels of cable without the need for additional packaging.

While specific embodiments of the invention have been illustrated and described herein, it is realized that numerous modifications and changes will occur to those skilled in the art. It is therefore to be understood that the appended claims are intended to cover all such modifications and changes that fall within the true spirit and scope of the invention.

The invention claimed is:

1. A cartridge system for a cable reel, the cartridge system comprising:

a case configured to hold the cable reel;

a pair of wheels attached to the case; and a lid rotatably connected to the case via a hinge, the lid configured to cover an opening of the case in a closed position and to allow, in an opened position, an operator to tilt and roll the case on the wheels;

a pair of latches, the latches having a first end rotatably connected to the lid and a second end having a slot latchable onto a pin on the inside of the case such that when the lid is in the opened position the second end of the latches slides downward for the slot to be latched onto the pin and to hold the lid in an open position; and a cord having opposite ends attached to the second end of each of the latches, such that when the latches are latched onto the case a pull of the cord unlatches each of the latches from the case.

2. The cartridge system of claim 1 further comprising:

a pair of reel roller elements inside the case, each of the reel roller elements having ends that are connected to opposite sides of the case, each of reel roller elements having a roller rotatable within the case, the roller configured to receive a flange of the cable reel such that the cable reel is rotatable within the case.

3. The cartridge system of claim 1, wherein the case is a first case, the cartridge system further comprising:

a second case configured to hold a second cable reel, the second case stackable onto the lid of the first case when the lid is in the closed position; and a connector configured to connect the second case to the lid of the first case;

a handle in the second case, the handle configured to allow the operator to tilt and roll the case on the wheels when the second case is stacked onto the first case.

* * * * *